US006085926A

United States Patent [19]

Weiss

[11] Patent Number: 6,085,926

[45] Date of Patent: Jul. 11, 2000

[54] FLOATING COOLER WITH DRINK TRAY

[76] Inventor: Thomas C. Weiss, 30252 Pacific Island Dr., #206, Laguna Niguel, Calif. 92677

[21] Appl. No.: 09/229,397

[22] Filed: Jan. 11, 1999

[51] Int. Cl.[7] ..... B65D 21/02

[52] U.S. Cl. ..... 220/23.86; 220/23.83; 220/560; 206/514

[58] Field of Search ..... 220/23.83, 23.86, 220/23.8, 560; 206/514, 501

[56] References Cited

U.S. PATENT DOCUMENTS

| | | | |
|---|---|---|---|
| 1,569,157 | 1/1926 | Thompson . | |
| 2,749,198 | 6/1956 | Berber | 220/23.8 |
| 3,397,804 | 8/1968 | Davis | 220/23.8 |
| 3,401,535 | 9/1968 | Palmer . | |
| 3,799,386 | 3/1974 | Madalin et al. | 220/444 |
| 3,942,671 | 3/1976 | Florian | 220/23.8 |
| 4,225,052 | 9/1980 | Tector et al. | 220/506 |
| 4,280,336 | 7/1981 | Taylor . | |
| 4,534,474 | 8/1985 | Ng | 211/70 |
| 4,541,539 | 9/1985 | Matthews . | |
| 4,643,312 | 2/1987 | Zarges | 206/514 |
| 4,655,062 | 4/1987 | Garcia . | |
| 4,871,079 | 10/1989 | Doucette et al. . | |
| 4,887,716 | 12/1989 | Abraham . | |
| 4,916,923 | 4/1990 | Adams et al. . | |
| 4,927,041 | 5/1990 | Hepburn . | |
| 4,974,426 | 12/1990 | Gomez et al. . | |
| 5,605,056 | 2/1997 | Brown et al. . | |
| 5,842,596 | 12/1998 | Renfroe | 220/739 |

*Primary Examiner*—Stephen Castellano
*Attorney, Agent, or Firm*—Gene Scott-Patent Law & Venture Group

[57] ABSTRACT

A cooler chest is mounted into a lower container which allows the chest to float without tendency for upending or taking on water. The lower container provides openings for resting items such as drink cans and cups, loose change and keys while one plays in the water. The lower container is of such size and buoyant volume as to support the chest when it is filled with water without allowing the items on the lower container to become wet.

7 Claims, 3 Drawing Sheets

FLOATING COOLER WITH DRINK TRAY

BACKGROUND OF THE INVENTION

1. Field of the Invention

This invention relates generally to cooler chests, and more particularly to a floating cooler having a separable buoyant tray support for holding drinks, etc.

2. Description of the Related Art

The following art defines the present state of this field: Brown et al., U.S. Pat. No. 5,605,056 describes a portable cooler for use with fish bait as well as food and beverage, including a housing having an insulated bottom, side walls, and a pivotal top hinged to one of the side walls. There is support positioned within the housing with the support having side walls and a bottom. There is a space for ice defined between a plurality of the housing side walls and a plurality of the support side walls. There are a plurality of drawers movable in the support and accessible from outside of one of the housing side walls. Each drawer includes a front, side walls, and a bottom, at least one of the drawers having a grate supported on the side walls above the drawer bottom, the space beneath the grate and above the drawer bottom providing a container for ice to cool articles positioned on the grate, but to keep the articles spaced from the ice positioned beneath the grate.

Gomez et al., U.S. Pat. No. 4,974,426 describes a cooler for storing ice, water and food stuff defining an insulated compartment. Several beverage container holders are disposed around the housing and include connecting openings that allow the cold water in. These holders extend below the plane of the bottom wall in order to maximize the level of the water contained in the holder and thereby increasing the heat exchange area with the container. At least one container dispensing assembly is provided for stacking up the containers adjacent to the peripheral wall and allowing the containers to roll over the bottom wall and outwardly through an aperture on the lower end of the wall. The bottom wall includes a depression in the area below the aperture to cause the water to accumulate thereon and increase the heat exchange area with the container as it passes through. A convexity on the internal surface of the bottom wall prevents any water from collecting thereon.

Hepburn, U.S. Pat. No. 4,927,041 describes a self-stabilizing floating cooler. The cooler includes a pair of upstanding, opposed end panels and elongated side panels extending there between to form a contiguous wall. A lid and a bottom panel are provided, and a floor panel is disposed between the lid and the bottom panel to define upper and lower compartments. The upper compartment is thermally insulated, and float members are detachably affixed to the side panels adjacent the floor panel exteriorly thereof. Perforations are provided in the lower compartment for filling the lower compartment with water to buoyantly stabilize the cooler in an upright position when the cooler is placed on water. Perforations also permit draining the water from the lower compartment when the cooler is removed from water.

Adams et al., U.S. Pat. No. 4,916,923 describes a beverage cooler insert that is set forth wherein a first support tray is reciprocatably mounted relative to a second support tray with each support tray provided with an individual "U" shaped support bracket to be received within an associated container cooler arrangement. The first and second support trays are reciprocatably mounted relative to one another utilizing support posts telescopingly received within support sleeves and biased outwardly relative to one another to effect engagement of the sides of the beverage cooler container by the support trays. Each support tray is provided with series of cylindrical cavities provided with slots through side walls of the cavity to effect contact of a cooling medium with containers positioned within the cavities.

Abraham, U.S. Pat. No. 4,887,716 describes a floating beverage carrier apparatus for cans and bottles wherein the apparatus includes an apertured floatation member provided with a plurality of collapsible receptacles for supporting the beverage containers in the apparatus during use; and, wherein the receptacles are adapted to be collapsed within the apertures during storage of the apparatus.

Doucette et al., U.S. Pat. No. 4,871,079 describes an integral floating cooler structure including a barge member having a barge bottom and barge sides with a storage chest having a chest bottom formed in common with the barge bottom, and chest sides of less thickness than the barge sides and having lower containers formed in common with the barge sides. The chest bottom and said chest sides are of thickness sufficient to provide thermal insulation. The barge bottom and the barge sides are displacement volume sufficient to provide buoyancy for the cooler structure. The exterior surfaces of the chest sides; the barge sides and the barge bottom forms a common exterior surface for the cooler structure. The interior surface of the chest bottom and the chest sides forms a common interior surface for the cooler structure.

Garcia, U.S. Pat. No. 4,655,052 describes a portable cooler including a main cavity chest for storing foodstuffs and coolant. An auxiliary cavity is used to store beverages which can be consumed simultaneously while being cooled. A partition separates the main cavity and the auxiliary cavity for enabling cool air to be circulated from the main chamber to the auxiliary chamber while preventing items in the main chamber to enter the auxiliary chamber.

Matthews, U.S. Pat. No. 4,541,539 describes a composite support system for fisherman including a compartmented cooler for both bait and catch as well as for drinks, food and the like. Also a tackle box means is provided as is a cutting board area along with built-in rod holders to meet all of the basic needs of the fisherman which ordinarily requires a multiplicity of various and sundry pieces of equipment to accomplish the same result.

Taylor, U.S. Pat. No. 4,280,336 describes a small portable cooler for carrying cylindrical type beverage containers and foodstuff. A handle is integrally molded with the body of the cooler so that it can be carried by one hand. A cold pack is supported in a coolant chamber which distributes cold air to the cylindrical container compartments within the cooler body. A food container is removably secured to a back wall of the container body. The back wall also serves as a support surface for the beverage containers about the food container.

Palmer, U.S. Pat. No. 3,401,535 describes a container for carrying loose items comprising an outer case having an open top; an insert having a top surface provided with an outer edge conforming substantially to the shape of the top of case. The insert has recessed open top cavities depending from the top surface for receiving the loose items. The cavities extending into the case when the insert is positioned on top of the case securing the insert to the case and providing a liquid seal there between, a cooling medium being capable of being frozen to store cold and then slowly absorbing heat. The cooling medium is sealed within the void between said outer case and said insert and a removable lid. The lid fits over the outer case to close the top of the recessed cavities and retain the loose items in the container.

Thompson, U.S. Pat. No. 1,569,157 describes a carrier having a liquid tight bottom and side walls with an ice open topped pan fitting within the carrier having a bottom provided with a multiplicity of perforations, forming chambers open top and bottom, with spaces separating adjacent chambers, open at the top only and a means to carry and support the carrier.

The prior art teaches various forms of cooler chests including some that are designed for being placed on water as in a stream or pool, and those that have a means for supporting a drink on the exterior of the cooler. The prior art also teaches drink holders such as trays. However, the prior art does not teach that a cooler chest may be constructed with a tray or lower container having the ability to support the buoyant weight of the cooler chest while keeping items resting on it from becoming wet. The present invention fulfills these needs and provides further related advantages as described in the following summary.

SUMMARY OF THE INVENTION

The present invention teaches certain benefits in construction and use which give rise to the objectives described below.

The present invention provides a cooler chest is mounted into a lower container which allows the chest to float without tendency for upending or taking on water. The lower container provides openings for resting items such as drink cans and cups, loose change and keys while one plays in the water. The lower container is of such size and buoyant volume as to support the chest when it is filled with water without allowing the items on the lower container to become wet.

A primary objective of the present invention is to provide a floating cooler chest having advantages not taught by the prior art.

Another objective is to provide such a chest further enabling the storage of items on the exterior from becoming wet.

A further objective is to enable the chest and the lower container to be separated for separate utility functions.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
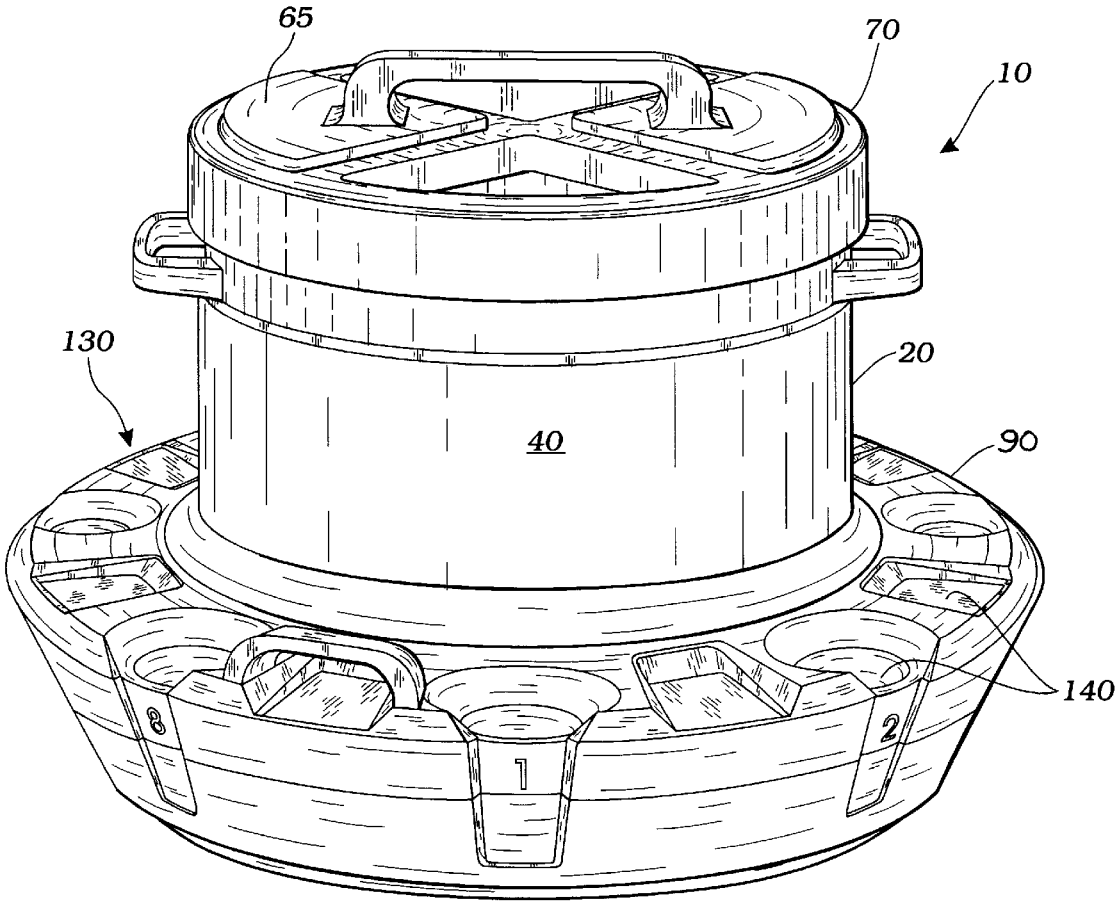
FIG. 1 is a perspective view of the preferred embodiment of the present invention.
Figure 2:
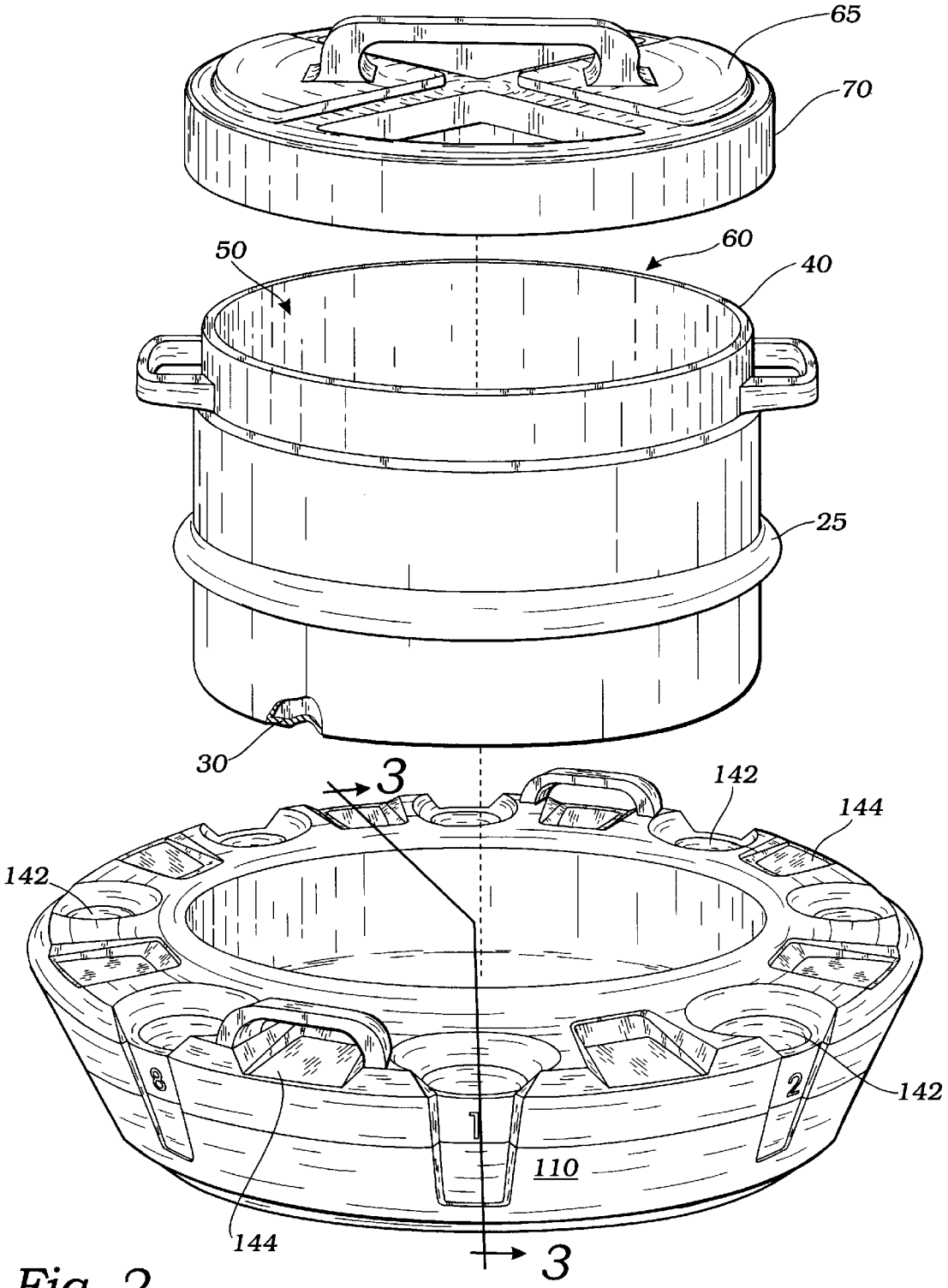
FIG. 2 is an exploded view thereof.

The above described drawing figures illustrate the invention, a cooler apparatus 10 comprising: an upper container 20 providing an upper container bottom plate 30 and an upper container side wall 40 configured to form an enclosure defining an upper container volume 50 and having an upper container access opening 60 therein; a cover 65 adapted for removable attachment to the upper container 20 for covering the upper container access opening 60, such adaptation being a tight frictional fit wherein a side flange 70 of the cover 65 fits over, and in contact with the upper container side wall 40; a lower container 90 providing a lower container bottom plate 100 (see FIG. 3) and a lower container side wall 110 configured to form a lower container enclosure having a lower container access opening 120 therein, the upper container, cover and lower container are all made of a material such as a plastic or other thermal insulator, and construction so as to inhibit thermal energy transfer therethrough; the lower container access opening 120 adapted by its size and shape for accepting the upper container 20 therein such that the upper container extends upwardly from the lower container 90 and is either separable or inseparable therefrom, the lower container 90 providing a generally horizontal annular upwardly facing skirt 130 extending outwardly from the upper container side wall 40 over, preferably a full Pat. No. 360°, i.e., forming a circular rim surface, the annular skirt 130 providing means for item storage 140 thereon; wherein with the apparatus 10 floated on the surface of a body of water (not shown) the lower container 90 is of such a size and shape as to displace a volume of water greater than the upper container volume 50 before the annular skirt 130 of the lower container 90 becomes submerged. This as been discovered to provide the necessary operating function to assure that the lower container does not become swamped when the load carried within the upper container is great. It has been found that if the upper container is filled with drinks and food items, as is a typical use of such coolers, that such items will not surpass the mass of the same volume of water. Therefore the above construction has been discovered to be operative in beneficially assuring that the items carried in the item storage spaces 142 and 144 do not become wet or water logged.

Beneficially, the upper container 20 provides an annular belt structure 25 positioned immediately above the annular skirt 130 of the lower container 90 and extending outwardly from the upper container side wall 40. This structure, is preferably a convex shape so that water which may flow down the upper container sidewall tends to move away from the joint between the upper and the lower container for preventing mildew and loosening of any adhesive used therein.

Preferably, the means for item storage 140 comprises a plurality of drink wells 142, each of the drink wells being adapted for accepting a drink container (not shown) therein, and further comprising a plurality of shallow wells 144 adapted for accepting coins and keys (not shown). Of course other items may be stored in these storage means 140 and such may be formed to adapted to the holding of other items.

Beneficially, the lower container side wall 110 is downwardly convergent and circular. It has been found that this conformation in a side wall for an apparatus of the present type enables a much improved movement through the water without causing splashes to overflow the horizontal annular skirt 130.

Figure 3:
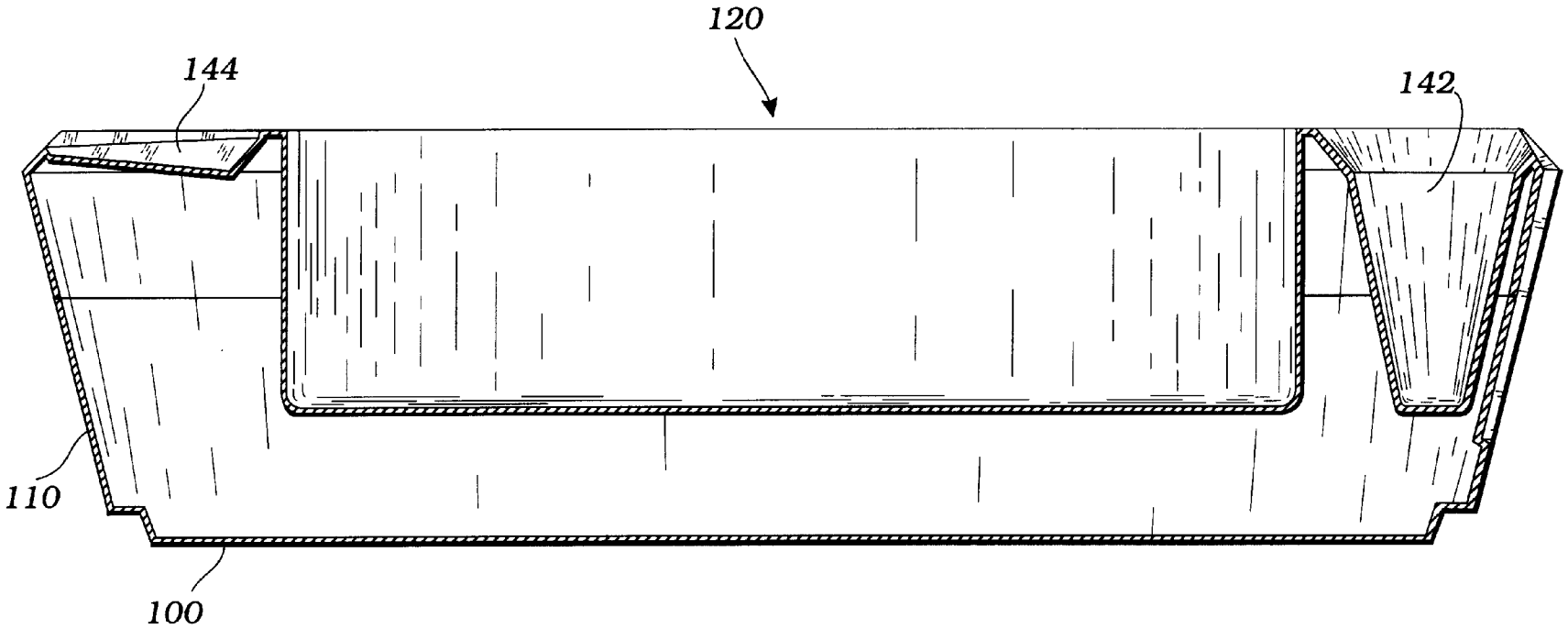
FIG. 3 is a sectional view thereof taken along line 3—3 in FIG. 2.

In use the upper container is placed into the access opening of the lower container and it is considered an important feature that the fit of these two items be somewhat tight so that the containers are not easily parted. Alternately, the two containers may be fastened together with adhesives or otherwise. When the containers may be separated the upper container may be used as a standard cooler while the lower container is used, at the same time, for dry storage of items while floating in the water. In FIG. 3 the interior 112 of the lower container is shown empty, but this space may be filled with a light density material such as a foam for rigidity of the lower container without loosing buoyancy.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A cooler apparatus comprising:

an upper container providing an upper container bottom plate and an upper container side wall configured to form an enclosure defining an upper container volume and having an upper container access opening therein, and made of a material and construction so as to inhibit thermal energy transfer therethrough;

a cover adapted for removable attachment to the upper container for covering the upper container access opening, the cover made of a material and construction so as to inhibit thermal energy transfer therethrough;

a lower container providing a lower container bottom plate and a lower container side wall configured to form a lower container enclosure having a lower container access opening therein, and made of a material and construction so as to inhibit thermal energy transfer therethrough;

the lower container access opening adapted for accepting the upper container therein such that the upper container extends upwardly from the lower container, the lower container providing a upwardly facing, uniformly wide, circular, annular skirt extending outwardly from the upper container side wall, the annular skirt providing means for item storage thereon;

wherein with the apparatus floated on the surface of a body of water the lower container is of such a size and shape as to displace a volume of water greater than the upper container volume before the annular skirt of the lower container is submerged.

2. The apparatus of claim 1 wherein the upper container provides an annular belt structure positioned immediately above the annular skirt of the lower container and extending outwardly from the upper container side wall.

3. The apparatus of claim 1 wherein the means for item storage comprises a plurality of drink wells, each of the drink wells being adapted for accepting a drink container therein, and further comprising a plurality of shallow wells adapted for accepting coins and keys, said drink wells and said shallow wells being positioned for open access when the upper container is engaged with the lower container.

4. The apparatus of claim 1 wherein the lower container side wall is downwardly convergent.

5. The apparatus of claim 1 wherein the lower container side wall is circular.

6. The apparatus of claim 1 wherein the upper container is inseparable from the lower container.

7. The apparatus of claim 1 wherein the upper container is separable from the lower container.

* * * * *